US010119176B2

(12) United States Patent
Rajan

(10) Patent No.: US 10,119,176 B2
(45) Date of Patent: Nov. 6, 2018

(54) SUPERELASTIC WIRE AND METHOD OF FORMATION

(75) Inventor: Sunder S. Rajan, Anaheim, CA (US)

(73) Assignee: RAYTHEON COMPANY, Waltham, MA (US)

( * ) Notice: Subject to any disclaimer, the term of this patent is extended or adjusted under 35 U.S.C. 154(b) by 1260 days.

(21) Appl. No.: 13/328,362

(22) Filed: Dec. 16, 2011

(65) Prior Publication Data

US 2013/0153095 A1 Jun. 20, 2013

(51) Int. Cl.

| | |
|---|---|
| ***C21D 9/00*** | (2006.01) |
| ***C21D 9/52*** | (2006.01) |
| ***C22F 1/00*** | (2006.01) |
| ***C22C 19/03*** | (2006.01) |
| ***C22C 19/00*** | (2006.01) |
| ***C22F 1/10*** | (2006.01) |
| ***H01Q 1/12*** | (2006.01) |
| ***H01Q 19/13*** | (2006.01) |

(52) U.S. Cl.

CPC ..... *C21D 9/52* (2013.01); *C22C 19/007* (2013.01); *C22C 19/03* (2013.01); *C22F 1/00* (2013.01); *C22F 1/10* (2013.01); *H01Q 1/1235* (2013.01); *H01Q 19/13* (2013.01)

(58) Field of Classification Search

CPC ..... C21D 9/52; C22C 19/007; C22C 19/03; C22F 1/00

USPC ..... 148/402, 559, 563, 580

See application file for complete search history.

(56) References Cited

U.S. PATENT DOCUMENTS

| | | | | |
|---|---|---|---|---|
| 5,272,486 | A | 12/1993 | Dickinson | |
| 6,225,953 | B1 * | 5/2001 | Kamei et al. | 343/702 |
| 6,375,458 | B1 | 4/2002 | Moorleghem et al. | |
| 6,422,010 | B1 * | 7/2002 | Julien | F01D 25/005 60/527 |
| 6,888,513 | B1 | 5/2005 | Graham et al. | |
| 7,288,326 | B2 | 10/2007 | Elzey et al. | |
| 2004/0168752 | A1 | 9/2004 | Julien | |
| 2007/0293939 | A1 | 12/2007 | Shirvastava et al. | |
| 2011/0097543 | A1 | 4/2011 | Lalli et al. | |

FOREIGN PATENT DOCUMENTS

| | | | | |
|---|---|---|---|---|
| EP | 0 508 414 A1 | | 10/1992 | |
| EP | 1 762 633 A1 | | 3/2007 | |
| JP | 59104459 | * | 6/1984 | C22F 1/02 |
| JP | 59104459 A | * | 6/1984 | C22F 1/02 |

(Continued)

OTHER PUBLICATIONS

"Nitinol Wire", *Fort Wayne Metals*, http://www.fwmetals.com/nitinol-wire.php (accessed Feb. 25, 2013), 3 pages.

(Continued)

*Primary Examiner* — Melvin C. Mayes

(74) *Attorney, Agent, or Firm* — Lewis Roca Rothgerber Christie LLP

(57) ABSTRACT

A shape memory alloy including a Ni—Ti based alloy is superelastic at temperatures of about −40° C. to about 60° C. after being exposed to temperatures of about −55° C. to about 85° C. A method of forming a memory shape alloy may include preparing a rod comprising a Ni—Ti alloy, drawing a wire from the rod, and treating the wire at a temperature of about 500° C. to about 550° C. for about less than 1 minute.

19 Claims, 3 Drawing Sheets

(56) References Cited

FOREIGN PATENT DOCUMENTS

| | | | | |
|---|---|---|---|---|
| JP | 61015995 | | 6/1984 | |
| JP | 61015995 | A * | 1/1986 | ..... C25D 7/00 |
| JP | 03-016402 | | 1/1991 | |
| JP | 05-185251 | | 7/1993 | |
| JP | 07-126780 | | 5/1995 | |
| JP | 2001-049410 | | 2/2001 | |
| JP | 59104459 | | 5/2001 | |

OTHER PUBLICATIONS

"Nickel Titanium", *Wikipedia*, http://en.wikipedia.org/wiki/ Nickel_titanium (accessed Feb. 25, 2013), 8 pages.

Brachet, et al., "Superelasticity and Impact Properties of Two Shape Memory Alloys: $Ti_{50}Ni_{50}$ and $Ti_{50}Ni_{48}Fe_2$", J. Phys, IV France 7 (1997), Article published online by EDP Sciences, available at http://dx.doi.org/10.1051/jp4;1997589, Nov. 1997, (pp. C5-561-C566).

Nemat-Nasser, "Superelastic and Cyclic Response of NiTi SMA at Various Strain Rates and Temperatures", Mechanics of Materials 38, available at www.sciencedirect.com, 2006, (pp. 463-474).

Written Opinion of the International Searching Authority for International Application No. PCT/US2012/064537, filed Nov. 9, 2012, Written Opinion of the International Searching Authority mailed Feb. 4, 2014 (6 pgs.).

International Search Report for International Application No. PCT/US2012/064537, filed Nov. 9, 2012, International Search Report dated Jan. 23, 2014 and mailed Feb. 4, 2014 (4 pgs.).

Office action in corresponding Canada Application No. 2,856,373, filed Nov. 9, 2012, Office action dated Oct. 18, 2016 (3 pgs.).

Canadian Office action dated Oct. 2, 2017 in corresponding Canada Patent Application No. 2,856,373 (3 pages).

* cited by examiner

SUPERELASTIC WIRE AND METHOD OF FORMATION

FIELD OF THE INVENTION

The present invention relates to superelastic wires, and more particularly, to a shape memory alloy wire having superelastic properties and a method for Miming the same.

BACKGROUND

Shape memory alloys often have some superelastic properties. However, the superelastic properties are generally only present over a narrow temperature range. The superelastic properties also are generally not present if the alloy is bent beyond its elastic limits (i.e., the angle of the bend is too severe). Thicker shape memory alloy wires also have not been shown to perform as well as thinner wires. Furthermore, some shape memory alloy wires exhibit low austenite finish temperatures, lower ultimate tensile strength, lower upper plateau stress limits, and higher residual strain after superelastic deformation. However, there is a need for superelastic wires that exhibit superelasticity over a wide temperature range, that have the ability to retain superelasticity despite a severe bend, and exhibit good strength, stress limits, and lower residual strain after superelastic deformation.

SUMMARY

The present invention relates to superelastic wires, and more particularly, to shape memory alloy wires having superelastic properties. The shape memory alloy wires exhibit superelastic properties up to a relatively large diameter and over a wide temperature range.

A shape memory alloy according to an embodiment of the invention includes a Ni—Ti based alloy, wherein the alloy is superelastic at temperatures of about −40° C. to about 60° C. after being exposed to temperatures of about −55° C. to about 85° C. The alloy may be superelastic at temperatures of −40° C. to about 60° C. after being exposed to temperatures of about −55° C. to about 85° C. under up to about a 6% strain.

The alloy may have an austenite start temperature of about −60° C. and an austenite finish temperature of from −20° C. to 5° C.

The alloy may be about 54.5 wt % to about 57 wt % Ni, the balance being Ti and impurities.

The alloy may have a strain induced martensite transformation temperature of greater than about 60° C.

The alloy may be a wire having a diameter equal to or greater than 0.008 inches (about 0.02 cm) and equal to or less than 0.024 inches (about 0.06 cm).

The alloy may have an ultimate tensile strength of about 200 KSI (about 1.38 GPa) to about 211 KSI (about 1.45 GPa).

The alloy may have an upper plateau stress at 3% strain of greater than about 80 KSI (about 0.55 GPa).

The alloy may have an austenite finish temperature of about 5° C.

According to an embodiment of the present invention, a method of forming a shape memory alloy wire includes preparing a rod comprising a Ni—Ti alloy, drawing a wire from the rod, and treating the wire at a temperature of about 500° C. to about 550° C. for about less than about 1 minute.

The wire treatment may be for about 15 to about 45 seconds.

The wire treatment may include drawing the alloy through an oven.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

Figure 1:
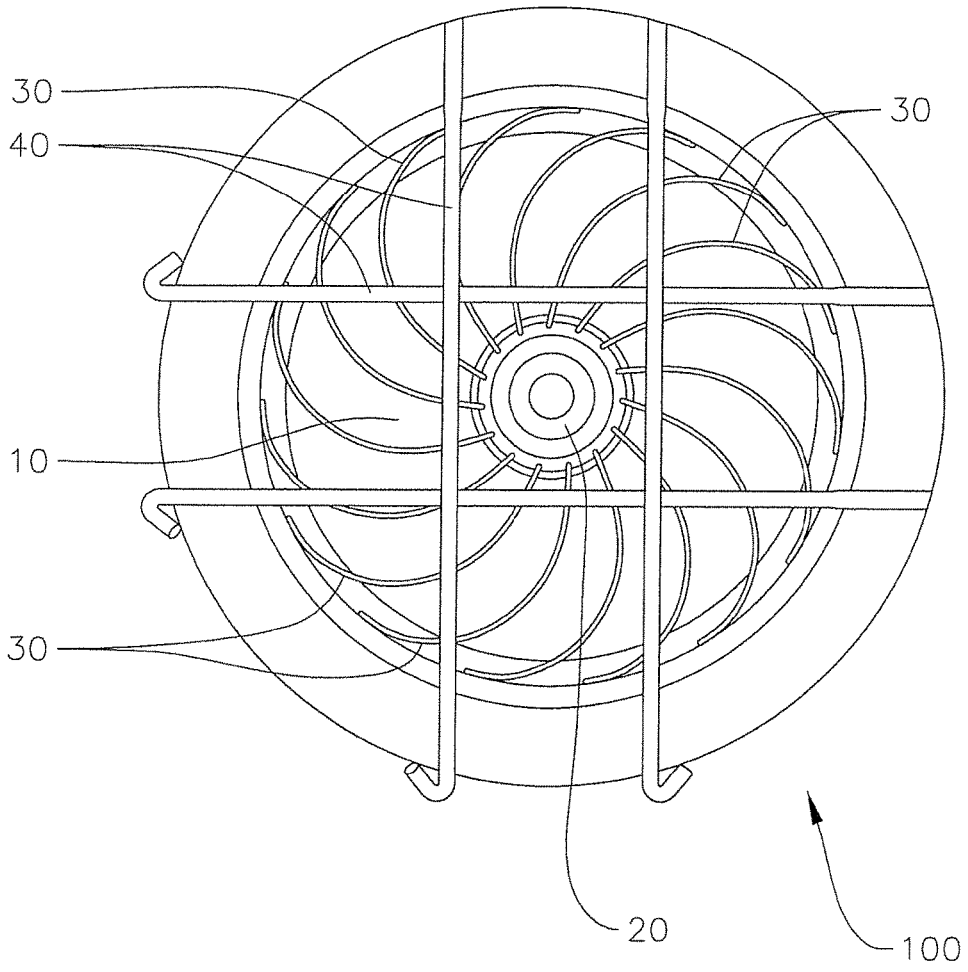
FIG. 1 is a schematic view of an antenna using the shape memory alloy wire according to an embodiment of the present invention in its collapsed (or closed) configuration.

In the following detailed description, only certain exemplary embodiments of the present invention are shown and described, by way of illustration. As those skilled in the art would recognize, the invention may be embodied in many different forms and should not be construed as being limited to the embodiments set forth herein. Like reference numerals designate like elements throughout the specification.

The present invention relates to superelastic wires, and more particularly, to a shape memory alloy wire having superelastic properties. A wire made of the shape memory alloy exhibits superelastic properties up to a relatively large diameter and over a wide temperature range. The shape memory alloy wire may have a diameter of up to and including about 0.024 inches (about 0.06 cm) and a diameter equal to or greater than about 0.008 inches (about 0.02 cm). For example, the shape memory alloy wire may have a diameter of greater than 0.014 (about 0.036) inches and equal to or less than 0.024 inches (about 0.06 cm). A 0.024 inch (about 0.06 cm) diameter wire of the present invention, set in a straight position, may be tightly wound around a 1.8 inch (about 4.6 cm) diameter mandrel, exposed to temperatures of about −55 to about 85° C., and when released from the mandrel at a temperature of about −40 to about 60° C., revert to being a straight-shaped wire.

The shape memory alloy contains about 54.5 to about 57 mass percent (mass %) nickel. In other words, the mass of the nickel in the alloy is about 54.5 to about 57 percent of the total mass of the alloy. The balance of the alloy contains titanium and may also contain various impurities as shown in Table 1, below.

TABLE 1

| Element | Approximate mass percent-mass/total mass |
|---|---|
| nickel | 54.5 to 57 |
| carbon, ≤ | 0.05 |
| cobalt, ≤ | 0.05 |
| copper, ≤ | 0.01 |
| chromium, ≤ | 0.01 |
| hydrogen, ≤ | 0.005 |
| iron, ≤ | 0.05 |
| niobium, ≤ | 0.025 |
| total nitrogen and oxygen, ≤ | 0.05 |
| titanium | balance |

The shape memory alloy wire may have various improved properties. For instance, it may have an austenite start temperature, annealed ($A_s$), of about −60±10° C. In some embodiments, it may have an $A_s$ of about −50° C., and in other embodiments, it may have an $A_s$ of about −70° C. It may have a maximum functional austenite finish temperature ($A_f$) of about −20 to 5° C. In some embodiments, it may have a functional austenite finish temperature of about −15 to 5° C. Preferably, it may have a maximum functional austenite finish temperature of about 5° C. The shape memory alloy wire may have an ultimate tensile strength at room temperature of about 200 to 211 KSI (kilopounds per square inch) (about 1.38 GPa (megapascals) to about 1.45 GPa). It may have an upper plateau stress at a strain of about 3% at room temperature of greater than about 80 KSI (about 0.55 MPa). The shape memory alloy may have a strain induced martensite transformation temperature ($M_d$) with a maximum residual strain of less than about 1% of greater than about 60° C. In some embodiments, it may have an $M_d$ with a maximum residual strain of less than about 1% of 60° C. The shape memory alloy wire may be superelastic at temperatures of between about −40 to 60° C. after being exposed to temperatures of between about −55 to 85° C. For example, after being bent or wound under a strain of about 6% and exposed to temperatures of between about −55 to 85° C., when released at temperatures of between about −40 to 60° C., the straight-wire shape memory alloy wire may substantially revert to being a straight wire. In other words, after being exposed to the above temperatures and strain, the straight shaped wire may revert to a substantially straight shape with a maximum distortion (bow) of about 0.7%.

Figure 2:
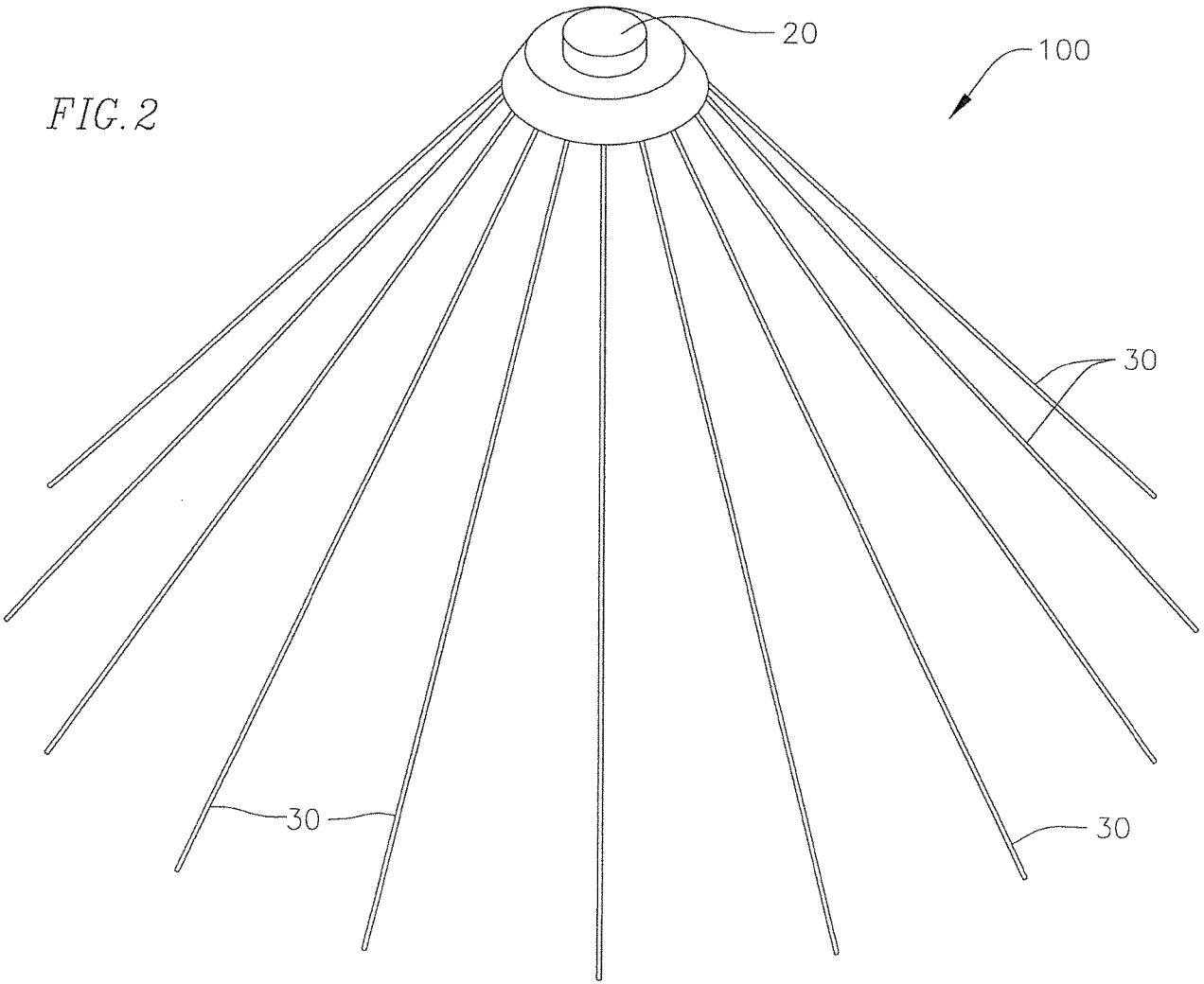
FIG. 2 is a schematic view of an antenna using the shape memory alloy wire according to an embodiment of the present invention in its operational (or open) configuration.

Shape memory alloy wires according to the present invention may be useful in various applications. One such application is for use in collapsible antennas. An exemplary collapsible antenna, in its collapsed configuration, is shown in FIG. 1. A schematic collapsible antenna, in its operational configuration, is shown in FIG. 2. A collapsible antenna 100 may include a reflector 10 and a feed 20. The feed may be connected to the reflector via straight-wire shape memory alloy wires 30 according to the present invention. When the antenna 100 is stowed in its collapsed condition, the wires 30 may be wound under a strain of about 6% and exposed to temperatures of between about −55 to 85° C. The antenna may be held in its collapsed condition using a locking mechanism such as bars 40, however, various locking mechanisms may be used. When the locking mechanism or bars 40 are released at temperatures of between about 40 to 60° C., the straight-wire shape memory alloy wire substantially reverts to being a straight wire, thus deploying the collapsible antenna in its operational condition as shown in FIG. 2.

Figure 3:
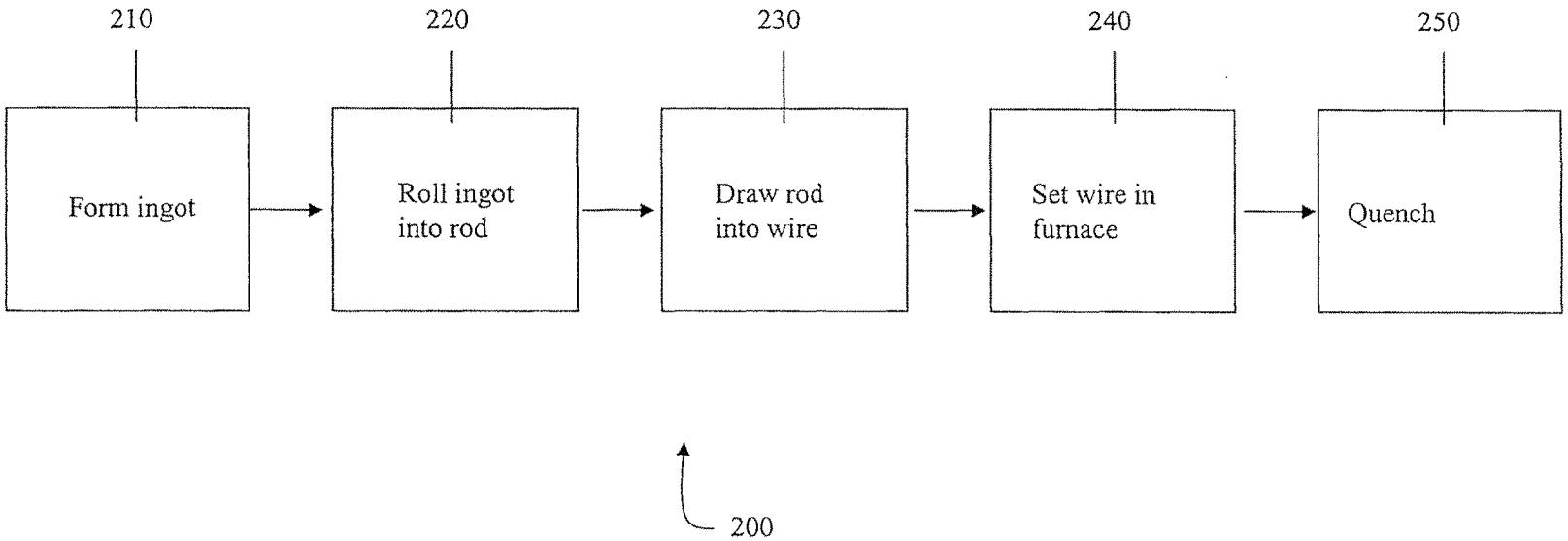
FIG. 3 is a flow chart of a method of forming a shape memory alloy wire having superelastic properties according to an embodiment of the present invention.

A method of making shape memory alloy wires according to the present invention 200 is depicted in FIG. 3. First, an ingot having a composition of the invention (e.g., $Ni_{54.5\text{-}57}Ti_{balance}$) may be formed 210. The ingot may then be rolled into a rod 220, for example, a ¼ inch (about 0.6 cm) rod. The shape memory alloy wire may then be drawn 230 from the ¼ inch (about 0.6 cm) rod to achieve a desired final diameter (e.g., up to 0.024 inches or 0.06 cm). The shape memory alloy wire is then treated or trained 240. While not being bound by this theory, it is believed that the unique properties of shape memory alloy wires of the present invention are the result, at least in part, of the unique training process. The shape memory alloy wire is pulled through a set fire furnace (e.g., a continuous oven or "hot zone") having a temperature of about 500 to 550° C. The wire is in the hot zone for about less than a minute, for example, between about 15 and 45 seconds. While these variables may depend upon the size and temperature of the oven, the speed the wire is pulled through the oven is adjusted so that the wire reaches a temperature of about 500 to 550° C. The wires are then rapidly quenched 250, setting the wire. The wire may be shaped into any form prior to quenching, and the wire will retain that form and exhibit superelasticity over the above described temperature ranges. For example, the wire may shaped as a straight wire and then quenched, thus setting the wire as a straight wire.

Example

An ingot of an alloy comprising about 56.1 wt % Ni, 0.02 wt % O, 0.03 wt % C, 0.0002 wt % H, less than 0.01 wt % Si, Cr, Co, Mo, W, and Nb, less than 0.01 wt % Al, Zr, Cu, Ta, Hf, and Ag, less than 0.01 wt % Pb, Bi, Ca, Mg, Sn, Cd, and Zn, less than 0.05 wt % Fe, less than 0.001 wt % B, with the balance being Ti was formed. Then, the ingot was formed (e.g., rolled) into a rod. A 0.014 inch (about 0.36 mm) diameter wire was then drawn from the rod. A six foot (about 1.8 m) length of the wire was then drawn through a 500° C. set fire furnace at about 24 feet per minute, thus each portion of the wire was exposed to 500° C. for about 15 seconds. The wire was set in a straight position and then quenched to form a shape memory alloy.

Comparative Example

An ingot of an alloy comprising about 56.1 wt % Ni, 0.05 wt % C and O, less than 0.01 wt % Ag, Al, As, Ba, Be, Bi, Ca, and Cd, less than 0.01 wt % Co, Cu, Hf, Hg, Mg, Mn, and Mo, less than 0.01 wt % Na, Nb, P, Pb, S, Sb, Se, and Si, less than 0.01 wt % Sn, Sr, Ta, V, W, Zn, and Zr, less than 0.05 wt % Fe, less than 0.001 wt % B, with the balance being Ti was foamed. Then, the ingot was formed (e.g., rolled) into a rod. A 0.008 inch (about 0.2 mm) diameter wire was then drawn from the rod. A six foot (about 1.8 m) length of the wire was then drawn through a 575° C. set fire furnace at about 20 feet per minute, thus each portion of the wire was exposed to 575° C. for about 18 seconds. The wire was set in a straight position and then quenched to form a shape memory alloy.

Testing

The shape memory alloy wire of the Example and Comparative Example were then tested to determine various properties using known methods. The Example was found to have an ultimate tensile strength at room temperature of 211 KSI and an upper plateau stress at room temperature at 3% strain of 86 KSI. It was also found to have a functional austenite finishing temperature of −7° C. In comparison, the Comparative Example was shown to have an ultimate tensile strength at room temperature of 176 KSI and an upper plateau stress at room temperature at 3% strain of 73 KSI. It was also found to have a functional austenite finishing temperature of −48° C.

The shape memory alloy wire of the Example and Comparative Example were then wound on a 1.8 inch (about 4.6 cm) diameter mandrel and exposed to −54° C. and stabilized at −54° C. for five minutes. The temperature was then raised to −40° C. and stabilized until the wire reached −40° C. and held at that temperature for five minutes. The wires were then removed and tested for straightness within 10 seconds.

The wires were then wound again on the mandrel and exposed to 80° C. and stabilized at 80° C. for five minutes. The temperature was then raised to 60° C. and stabilized until the wire reached 60° C. and held at that temperature for five minutes. The wires were then removed and tested for straightness within 10 seconds.

The wires were tested for straightness by allowing the wires "free roll" on a glass plate held at an angle of 5° from the horizontal plane. That is, the wires were allowed to roll down the angled plate. A roll without any significant wobble confirmed straightness of the wire. The Example (where the wire was made according to an embodiment of the invention) was substantially straight after the above test sequences at both high and low temperatures, while the Comparative Example (where the wire was not made according to an embodiment of the invention) was not, as it showed some wobble after the above test sequences at both high and low temperatures.

When lowered to room temperature, the Exemplary wire only had about 0.1% residual strain, as a 12 inch (about 30.5 cm) length of the shape memory alloy wire exhibited a maximum distortion of about 0.08" (about 0.2 cm). In comparison, the Comparative Example exhibited a residual strain at room temperature of 0.25% and was not substantially straight. Accordingly, it was surprisingly found that the Exemplary wire substantially reverted to its set shape, a straight wire, after being exposed to the above described temperature extremes, while the Comparative Example did not.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. A shape memory alloy comprising:

a Ni—Ti based alloy, wherein the Ni—Ti based alloy is superelastic at temperatures of −40° C. to about 60° C. after being exposed to temperatures of about −55° C. to about 85° C., wherein the Ni—Ti based alloy has an ultimate tensile strength of about 200 KSI (about 1.38 GPa) to about 211 KSI (about 1.45 GPa).

2. The shape memory alloy of claim 1, wherein the Ni—Ti based alloy is superelastic at temperatures of −40° C. to about 60° C. after being exposed to temperatures of about −55° C. to about 85° C. under up to about a 6% strain.

3. The shape memory alloy of claim 1, wherein the Ni—Ti based alloy has an austenite start temperature of about −60° C. and an austenite finish temperature of from −20° C. to 5° C.

4. The shape memory alloy of claim 1, wherein the Ni—Ti based alloy comprises about 54.5 wt % to about 57 wt % Ni, the balance being Ti and impurities.

5. The shape memory alloy of claim 1, wherein the Ni—Ti based alloy has a strain induced martensite transformation temperature of greater than about 60° C.

6. The shape memory alloy of claim 1, wherein the Ni—Ti based alloy is a wire having a diameter of equal to or greater than 0.008 inches (about 0.02 mm) and equal to or less than 0.024 inches (about 0.6 mm).

7. The shape memory alloy of claim 1, wherein the Ni—Ti based alloy has an upper plateau stress at 3% strain of greater than about 80 KSI (about 0.55MPa).

8. The shape memory alloy of claim 1, wherein the Ni—Ti based alloy has an austenite finish temperature of about 5° C.

9. A stowable antenna comprising wires comprising the shape memory alloy of claim 1.

10. A method of forming a shape memory alloy comprising:

preparing a rod comprising a Ni—Ti based alloy;

wherein the Ni-Ti based alloy is superelastic at temperatures of −40° C. to about 60° C. after being exposed to temperatures of about −55° C. to about 85° C., and wherein the Ni-Ti based alloy has an ultimate tensile strength of about 200 KSI (about 1.38 GPa) to about 211 KSI (about 1.45 GPa);

drawing a wire from the rod; and treating the wire at a temperature of about 500° C. to about 550° C. for about less than 1 minute.

11. The method of claim 10, wherein the treating the wire is performed for about 15 to about 45 seconds.

12. The method of claim 10, wherein the treated wire has an austenite start temperature of about −60° C. and an austenite finish temperature of from about −20° C. to about 5° C.

13. The method of claim 12, wherein the austenite finish temperature is about 5° C.

14. The method of claim 10, wherein the treated wire is superelastic at temperatures of −40° C. to about 60° C. after being exposed to temperatures of about −55° C. to about 85° C.

15. The method of claim 10, wherein the treated wire is superelastic at temperatures of −40° C. to about 60° C. after being exposed to temperatures of about −55° C. to about 85° C. under up to about a 6% strain.

16. The method of claim 10, wherein the treating the wire comprises drawing the alloy through an oven.

17. The method of claim 10, wherein the wire has a diameter of greater than equal to 0.008 inches (about 0.02 mm) and equal to or less than 0.024 inches (about 0.6 mm).

18. The method of claim 10, wherein the treated wire has a strain induced martensite transformation temperature of greater than about 60° C.

19. The method of claim 10, wherein the Ni—Ti alloy comprises about 54.5 wt % to about 57 wt % Ni, the balance being Ti and impurities.

* * * * *